US007304429B2

(12) United States Patent
Kawase

(10) Patent No.: US 7,304,429 B2
(45) Date of Patent: Dec. 4, 2007

(54) IMAGE DISPLAY APPARATUS WITH FIRST AND SECOND SUBSTRATES IN A HERMETIC CONTAINER SEALED BY A CONDUCTIVE BONDING MEMBER THEREBETWEEN

(75) Inventor: Toshimitsu Kawase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 10/606,234

(22) Filed: Jun. 26, 2003

(65) Prior Publication Data

US 2004/0008195 A1 Jan. 15, 2004

(30) Foreign Application Priority Data

Jun. 28, 2002 (JP) ..... 2002-190832

(51) Int. Cl.
*H01J 1/62* (2006.01)
*H01J 63/04* (2006.01)
*H01J 17/44* (2006.01)

(52) U.S. Cl. ..... 313/512; 313/594; 313/504

(58) Field of Classification Search ..... 313/495, 313/512, 597, 594, 504; 345/204
See application file for complete search history.

(56) References Cited

U.S. PATENT DOCUMENTS 5,343,115 A * 8/1994 Anandan et al. ..... 313/491
5,905,335 A * 5/1999 Fushimi et al. ..... 313/495
6,114,804 A 9/2000 Kawase et al. ..... 313/495
6,476,547 B1 * 11/2002 Kawase ..... 313/495
6,528,939 B1 3/2003 Kawase ..... 31/495
6,690,032 B1 * 2/2004 Umetsu ..... 257/72
2002/0005692 A1 * 1/2002 Ando ..... 313/495
2004/0080261 A1 * 4/2004 Yokota et al. ..... 313/495

FOREIGN PATENT DOCUMENTS

JP 11-67126 3/1999
JP 2000-211951 8/2000
JP 2000-260359 * 9/2000 ..... 313/583

* cited by examiner

*Primary Examiner*—Joseph Williams
*Assistant Examiner*—Peter Macchiarolo
(74) *Attorney, Agent, or Firm*—Fitzpatrick, Cella, Harper & Scinto

(57) ABSTRACT

An image display apparatus has a hermetic container having therein first and second substrates arranged opposite each other. An image display unit is disposed within the hermetic container and a conductive bonding member that seals the first substrate and the second substrate is disposed between the first and second substrates. The electric potential of the conductive bonding member is specified.

8 Claims, 7 Drawing Sheets

IMAGE DISPLAY APPARATUS WITH FIRST AND SECOND SUBSTRATES IN A HERMETIC CONTAINER SEALED BY A CONDUCTIVE BONDING MEMBER THEREBETWEEN

BACKGROUND OF THE INVENTION

1. Field of the Invention

The present invention relates to an image display apparatus and a manufacturing method thereof.

2. Related Background Art

An image display apparatus using electrons requires an envelope unit for keeping a vacuum atmosphere, an electron source for emitting the electrons, a drive circuit thereof, an image forming member including a fluorescent material that emits the light upon impingement of electrons, an acceleration electrode for accelerating the electrons toward the image forming member, and a power source thereof. Further, in an image forming apparatus employing a flat envelope unit as in the case of a thin type image forming apparatus, there might be a case where support columns are used as an atmospheric pressure resistant structured body.

Two types of electron emission elements such as a hot-cathode element and a cold-cathode element have hitherto known as the aforementioned electron emission elements. What is known as the cold-cathode element of these two types may be, for instance, a field emission type element (which will hereinafter be abbreviated to FE type), a metal/insulation layer/metal type emission element (which will hereinafter be abbreviated to MIM type) and a surface conduction type emission element.

FIG. 7 is a perspective view showing one example of a display panel unit configuring a flat type image forming apparatus, wherein a part of the panel is cut off in order to have its internal structure viewed.

Referring to FIG. 7, there are illustrated a rear plate designated by the numeral 3115, an external frame 3116 and a face plate 3117. The rear plate 3115, the external frame 3116 and the face plate 3117 configure an envelope unit (a hermetic container) for keeping an interior of the display panel in vacuum. A substrate 3111 is fixed to the rear plate 3115. (N×M) pieces of cold-cathode elements 3112 are formed on this substrate 3111 (N and M are positive integers of 2 or larger and are properly set corresponding to a desired number of pixels). Further, the (N×M) pieces of cold-cathode elements 3112 are, as shown in FIG. 7, wired by M-pieces of line-directional wires 3113 and N-pieces of row-directional wires 3114. A unit constructed of the substrate 3111, the cold-cathode elements 3112, the lie-directional wires 3113 and the row-directional wires 3114, is called a multi electron beam source. Moreover, an insulating layer (not shown is formed between these two types of wires leastwise at an intersection between the line-directional wire 3113 and the row-directional wire 3114, whereby the electric insulation is kept. A fluorescent screen 3118 composed of fluorescent materials is formed on the underside of the face plate 3117, and phosphors (not shown) in three primary colors such as red (R), green (G) and blue (B) are separately coated thereon. Further, black substances (not shown) are provided between the respective color fluorescent materials configuring the fluorescent screen 3118, and a metal-backed member 3119 composed of Al, etc. is formed on the surface, on the side of the rear plate 3115, of the fluorescent screen 3118.

The symbols Dx1 to Dxm, Dy1 to Dyn and Hv represent hermetically-structured electric connection terminals provided for electrically connecting the display panel described above to an electric circuit (not shown). The terminals Dx1 to Dxm electrically connect to the line-directional wires 3113 of the multi electron beam source, the terminals Dy1 to Dyn electrically connect to the row-directional wires 3114 of the multi electron beam source, and the terminal Hv to the metal-backed member 3119, respectively.

Further, an interior of the hermetic container is kept in vacuum on the order of 10-6 Torr. A means for preventing the rear plate 3115 and the face plate 3117 from being deformed or broken die to a pressure difference between the interior of the hermetic container and the exterior, is needed as a display areal size of the image display apparatus increases. A method based on thickening the rear plate 3115 and the face plate 3117 causes an increase in weight of the image display apparatus and also an image distortion and a parallax when viewed in an oblique direction. By contrast, referring to FIG. 7, there is provided a structure sustaining member (which is known as a spacer or a rib) 3120, constructed of a comparatively thin glass plate, for sustaining the atmospheric pressure. Thus, the substrate 3111 formed with the multi electron beam source and the face plate 3117 formed with the fluorescent screen 3118, are spaced normally sub-millimeters through several millimeters, and, as described above, the interior of the hermetic container is kept in high vacuum.

In the image display apparatus employing the display panel explained above, when a voltage is applied to the respective cold-cathode elements 3112, via the off-container terminals Dx1 to Dxm and Dy1 to Dyn, electrons are emitted from the respective cold-cathode elements 3112. Simultaneously, a voltage as high as several hundreds of volts (V) through several kilovolts (kV) is applied to the metal-backed member 3119 via the off-container terminal Hv, and the emitted electrons are accelerated and thus made to impinge on the internal surface of the face plate 3117. The color fluorescent materials configuring the fluorescent screen 3118 are thereby excited and become luminous, thus displaying an image.

Without being limited to the image display apparatus utilizing the electron emitting elements, there are known an image display apparatus employing electroluminescence elements and an image display apparatus known as a plasma display. Any type of image display apparatus includes an envelope unit that accommodates the display elements inside.

It is effective that a low melting point metal, etc. is used as a connecting member (serving for at least one of bonding and a hermetic connection) for connecting the substrate and the external frame which structures this envelope unit.

SUMMARY OF THE INVENTION

According to one aspect of the present invention, there is provided an image display apparatus which comprises a hermetic container including, as constructive members, a first substrate and a second substrate opposite to each other, and an image display means disposed within the hermetic container, wherein a conductive bonding member for sealing the first substrate and the second substrate is disposed between the first substrate and the second substrate, and an electric potential of the conductive bonding member is specified.

According to another aspect of the present invention, there is provided an image display apparatus which comprises first and second substrates opposite to each other, an external frame positioned between the first substrate and the second substrate, a first conductive member positioned between the external frame and the first substrate, and a second conductive member positioned on a surface other than a surface (which will hereinafter be called as an opposite surface), opposite to the first substrate, of the external frame and connected to the first conductive member, wherein an electric potential of the first conductive member is specified with the second conductive member serving as an electric path.

According to a further aspect of the present invention, a method of manufacturing an image display apparatus having a hermetic container including, as constructive members, a first substrate and a second substrate opposite to each other, and a image display means disposed within the hermetic container, which comprises a step of disposing a conductive bonding member between the first substrate and the second substrate, and sealing the first substrate and the second substrate by heating the conductive bonding member, and a step of specifying an electric potential of the conductive bonding member.

According to still another aspect of the present invention, a method of manufacturing an image display apparatus having a first substrate, a second substrate and a external frame provided between the first substrate and the second substrate, which comprises a connecting step of connecting the first substrate and the external frame to each other, wherein this connecting step includes a step of disposing a connecting material for connecting the first substrate and the external frame to each other on or in leastwise one of a surface (which will hereinafter be called an opposite surface), opposite to the first substrate, of the external frame and an areal (which will hereinafter be called an opposite area), opposite to the opposite surface, of the first substrate, and a heating step of connecting the first substrate and the external frame to each other through the connecting material by heating the connecting material in a state where the connecting material is positioned between the first substrate and the external frame, and leading the connecting material softened by heating to a surface other than the opposite surface of the external frame, wherein the connecting material assumes a conductivity in a state where at least the heating step has finished.

An object of the present invention is to provide the image display apparatus capable of stably performing a drive display and a manufacturing method thereof.

Another object of the present invention is to actualize a construction preferable to specifying the electric potential of the conductive connecting member.

DESCRIPTION OF THE PREFERRED EMBODIMENTS

Figure 1:
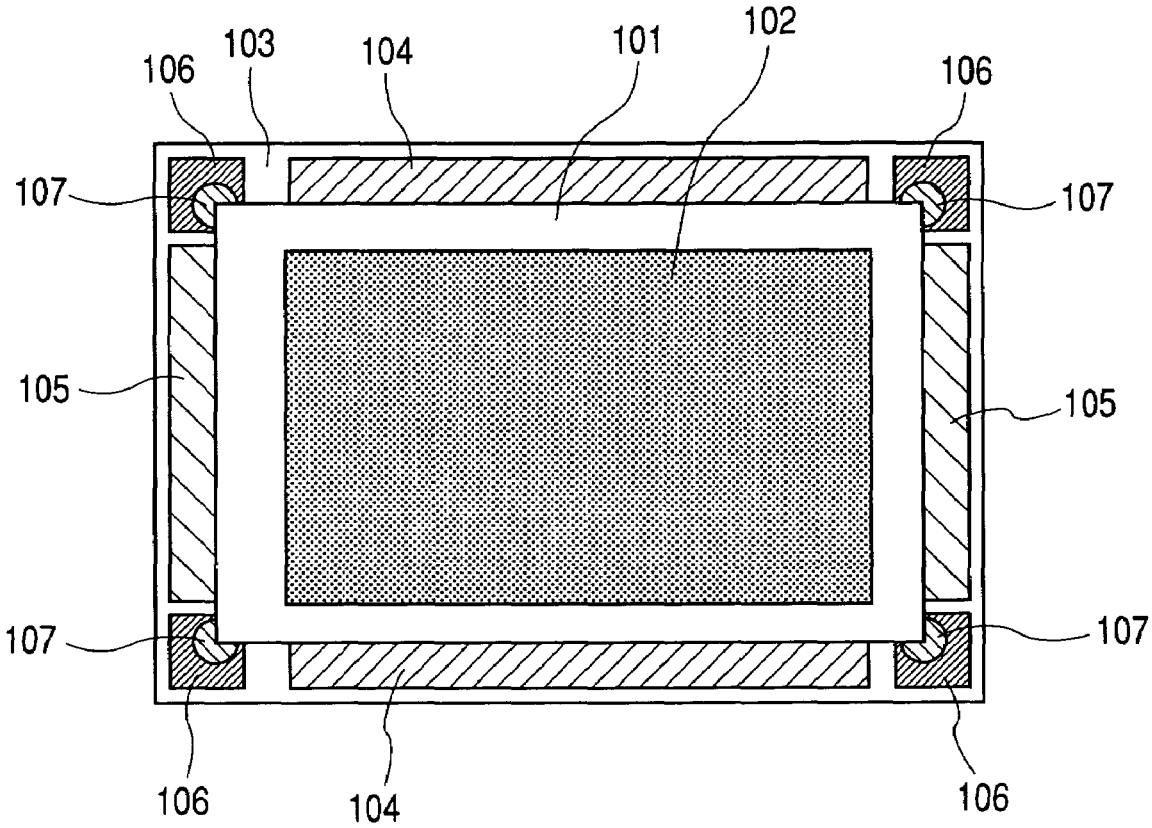
FIG. 1 is a view of a structure of a display panel of the present invention, illustrating the example 1.

According to the present invention, an image display apparatus has a hermetic container including, as constructive members, a first substrate and a second substrate opposite to each other, and an image display unit disposed within the hermetic container, wherein a conductive bonding member for sealing the first substrate and the second substrate is disposed between the first substrate and the second substrate, and an electric potential of the conductive bonding member is specified.

In the aforementioned image display apparatus, it is preferable that the conductive bonding member extends from a sealing area onto the surface of one of the first substrate and the second substrate outwardly of the hermetic container.

According to the present invention, an image display apparatus has a hermetic container including, as constructive members, a first substrate and a second substrate opposite to each other, and an external frame disposed between the first substrate and the second substrate, and an image display unit disposed within the hermetic container, wherein a conductive bonding member for sealing one of the first and second substrates and the external frame is disposed between one of the first substrate and the second substrate and the external frame, and an electric potential of the conductive bonding member is specified.

In the above image display apparatus, it is preferable that the conductive bonding member extends from a sealing area onto the surface of one of the first substrate and the second substrate outwardly of the hermetic container.

In the above image display apparatus, it is preferable that the conductive bonding member extends from a sealing area onto the surface of the other of the first substrate and the second substrate outwardly of the hermetic container.

Further, according to the present invention, an image display apparatus has first and second substrates opposite to each other, an external frame positioned between the first substrate and the second substrate, a first conductive member positioned between the external frame and the first substrate, and a second conductive member positioned on a surface other than a surface (which will hereinafter be called an opposite surface), opposite to the first substrate, of the external frame and connected to the first conductive member, wherein an electric potential of the first conductive member is specified with the second conductive member serving as an electric path.

Further, according to the present invention, a method of manufacturing an image display apparatus having a hermetic containing including, as constructive members, a first substrate and a second substrate opposite to each other, and an image display unit disposed within the hermetic container, includes a step of disposing a conductive bonding member between the first substrate and the second substrate, and sealing the first substrate and the second substrate by heating the conductive bonding member, and a step of specifying an electric potential of the conductive bonding member.

In the method of manufacturing the image display apparatus, it is preferable the electric potential specifying step is a step of connecting the conductive bonding member to a conductive member provided on the first substrate or the second substrate.

Further, in the method of manufacturing the image display apparatus, it is preferable that the electric potential specifying step is a step of connecting the conductive bonding member softened by heating in the sealing step to a conductive member provided on the first substrate or the second substrate.

Further, according to the present invention, a method of manufacturing an image display apparatus having a hermetic containing including, as constructive members, a first substrate and a second substrate opposite to each other, and an external frame disposed between the first substrate and the second substrate, and an image display unit disposed within the hermetic container, includes a step of disposing a conductive bonding member between the first substrate and the second substrate, and sealing the first substrate and the external frame by heating the conductive bonding member, and a step of specifying an electric potential of the conductive bonding member.

Further, in the method of manufacturing the image display apparatus, it is preferable that the electric potential specifying step is a step of connecting the conductive bonding member to a conductive member provided on the first substrate or the second substrate disposed opposite to the first substrate.

Further, in the method of manufacturing the image display apparatus, it is preferable that the electric potential specifying step is a step of connecting the conductive bonding member softened by heating in the sealing step to a conductive member provided on the first substrate or the second substrate disposed opposite to the first substrate.

According to the present invention, a method of manufacturing an image display apparatus having a first substrate, a second substrate and a external frame provided between the first substrate and the second substrate, includes a connecting step of connecting the first substrate and the external frame to each other, and this connecting step includes a step of disposing a connecting material for connecting the first substrate and the external frame to each other on or in leastwise one of a surface (which will hereinafter be called an opposite surface), opposite to the first substrate, of the external frame and an areal (which will hereinafter be called an opposite area), opposite to the opposite surface, of the first substrate, and a heating step of connecting the first substrate and the external frame to each other through the connecting material by heating the connecting material in a state where the connecting material is positioned between the first substrate and the external frame, and leading the connecting material softened by heating to a surface other than the opposite surface of the external frame, wherein the connecting material assumes a conductivity in a state where at least the heating step has finished. Particularly, it is preferable that the connecting material is led to such a position as to be capable of being conductive to an electrode provided on the second substrate by leading this connecting material to the surface other than the opposite surface of the external frame. The electrode provided on the second substrate may also be provided beforehand or provided after the heating step connoted herein.

In the case of using the conductive connecting member such as a low melting point metal, etc. as the connecting member (serving for at least one of bonding and a hermetic connection) for connecting the substrate and the external frame which structures this envelope unit (the hermetic container) containing the image display means of the image display apparatus, there might be a case where the electric potential of the connecting surface changes as it is influenced by a change in outside condition( such as static electricity, etc.) of the envelope unit. One of factors given herein is that a part of the connecting member is exposed to the outside air. Further, there might be a case in which the electric potential of the connecting member changes depending on a state of internal operation of the envelope unit. One of factors given herein is an influence of the electric potential of the electrode inside the envelope unit. To give a concrete example, this can be exemplified such that the external frame is electrified due to impingement, etc. of scattered electrons, and the electric potential of the connecting member fluctuates in the image display apparatus which utilizes jumping of the electrons within the envelope unit.

According to the present invention discussed above, it is possible to provide the image display apparatus capable of stably performing the drive display and the manufacturing method thereof. Further, according to the present invention discussed above, it is feasible to actualize the construction preferable to specifying the electric potential of the connecting member (the conductive connecting member).

Especially, it is possible to actualize the structure capable of facilitating electrical lead-outs from the connecting members (the conductive connecting members) for specifying the electric potentials and also the construction capable of easily specifying the electric potentials.

Embodiments

According to the present invention, a first conductive member is positioned between an external frame and a first substrate, and a second conductive member is positioned on a surface other than a surface, facing to the first substrate, of the external frame and is at the same time connected to a first conductive material. Namely, according to this configuration, an electric path to the first conductive member is formed, e.g., on the side surface of the external frame. Unlike the configuration of the present invention, if a leader of the first conductive member is provided on the first substrate, this arrangement must involve wiring on the first substrate and connecting this wire to the first conductive member, and hence there arise problems in which the processes of manufacturing the image display apparatus become complicated on the whole, and the first substrate has a restraint in size. According to the configuration of the present invention, however, the second conductive member is further connected to, e.g., an electrode of the second substrate, and an electric potential is specified from the second substrate, whereby formations of minute wires, etc. can be concentrated on the second substrate and the image display apparatus as a whole can be easily manufactured at a low cost.

The first substrate and the second substrate involve the use of, for example, a soda-lime glass material.

Metals such as In, Al, Cu, Au, Ag, Pt, Ti, Ni or alloys thereof can be utilized for the first conductive member. In the normal configuration, the first conductive member is a member that bonds the first substrate and the external frame together or a member that hermetically connects the first substrate and the external frame to each other. Accordingly, a preferable material is a metal having a low melting point that is equal to or lower than 400° C., and especially In is preferable.

The external frame positioned between the first substrate and the second substrate facing each other can involve the use of an insulator or a high resistor as a material, and, as in the case of the first substrate and the second substrate, for instance, the soda-lime glass material is preferable.

The second conductive member is positioned on the surface other than the surface (the opposite surface), facing to the first substrate, of the external frame and is a state of being electrically connected to the first conductive member.

Figure 4A:
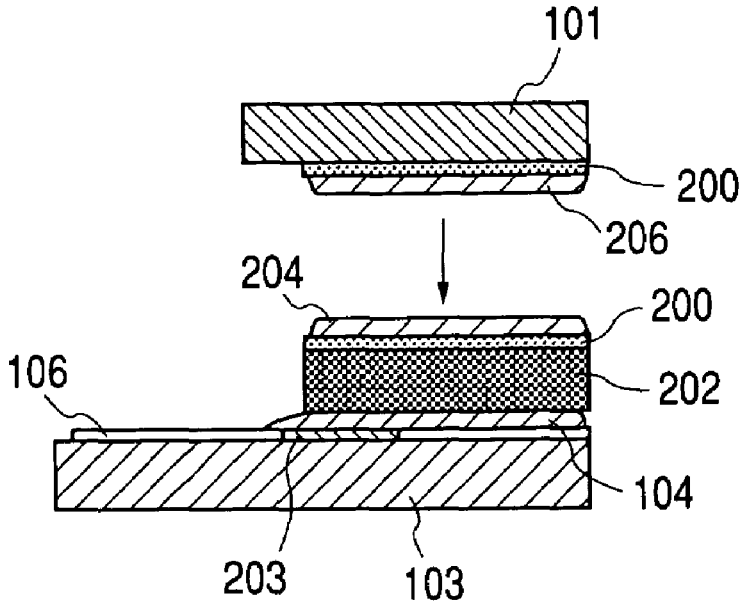
FIGS. 4A and 4B are partial sectional view sof the display panel, illustrating the example 1.
Figure 4B:
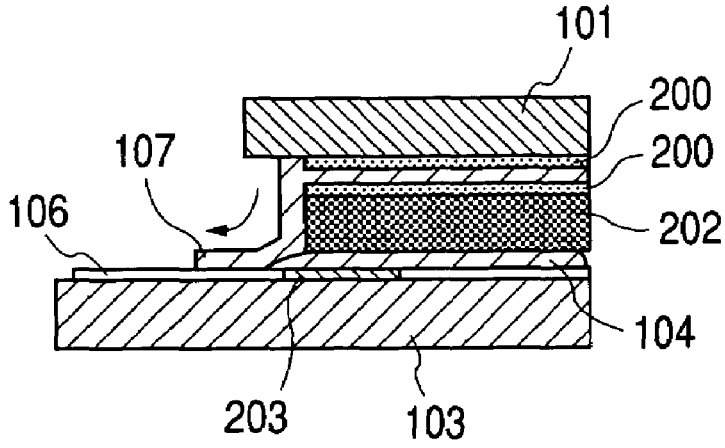

Both of the surfaces, facing the fist substrate and the second substrate, of the external frame, are flat in the normal configuration. Hence, (the surface other than the opposite surfaces) is, in the configuration of the normal external frame, a side surface between the surface facing the first substrate and the surface facing the second substrate. The side surface is not necessarily configured by one flat surface and may include a case of its being configured by a curvilinear surface or combining a multiplicity of flat surfaces. The general configuration is, however, rectangular in section as illustrated in FIGS. 4A and 4B.

Further, the second conductive member may be positioned on either an outer side surface (exposed to the outside air) of the external frame or an inner side surface (kept in vacuum) of the external frame. According to the construction of the normal image display apparatus, however, the installing position of the electrode, for specifying the electric potential, provided on the second substrate is restrained in terms of a size of the display unit and an installing area for wiring, etc., and it is therefore preferable that the second conductive member be positioned on the outer side surface of the external frame.

Moreover, the second conductive member can be easily manufactured and hence it is preferable from this point that the same material of the first conductive member be used, and, as will be explained later on, the sagging of the first conductive member can be used, however, the second conductive member may differ from the material of the first conductive member. Further, the second conductive member can be also formed by mixing the first conductive member with other members.

The first substrate may be a substrate positioned closer to the user (i.e., on an image viewing side) than the second substrate. Accordingly, the electric potential of the second conductive member is specified by the second substrate, and hence the user has no necessity of specifying the electric potential.

A plurality of wires for driving the display elements can be distributed on the second substrate, and therefore the electric potential of the first conductive member can be specified on the side of the second substrate.

Figure 7:
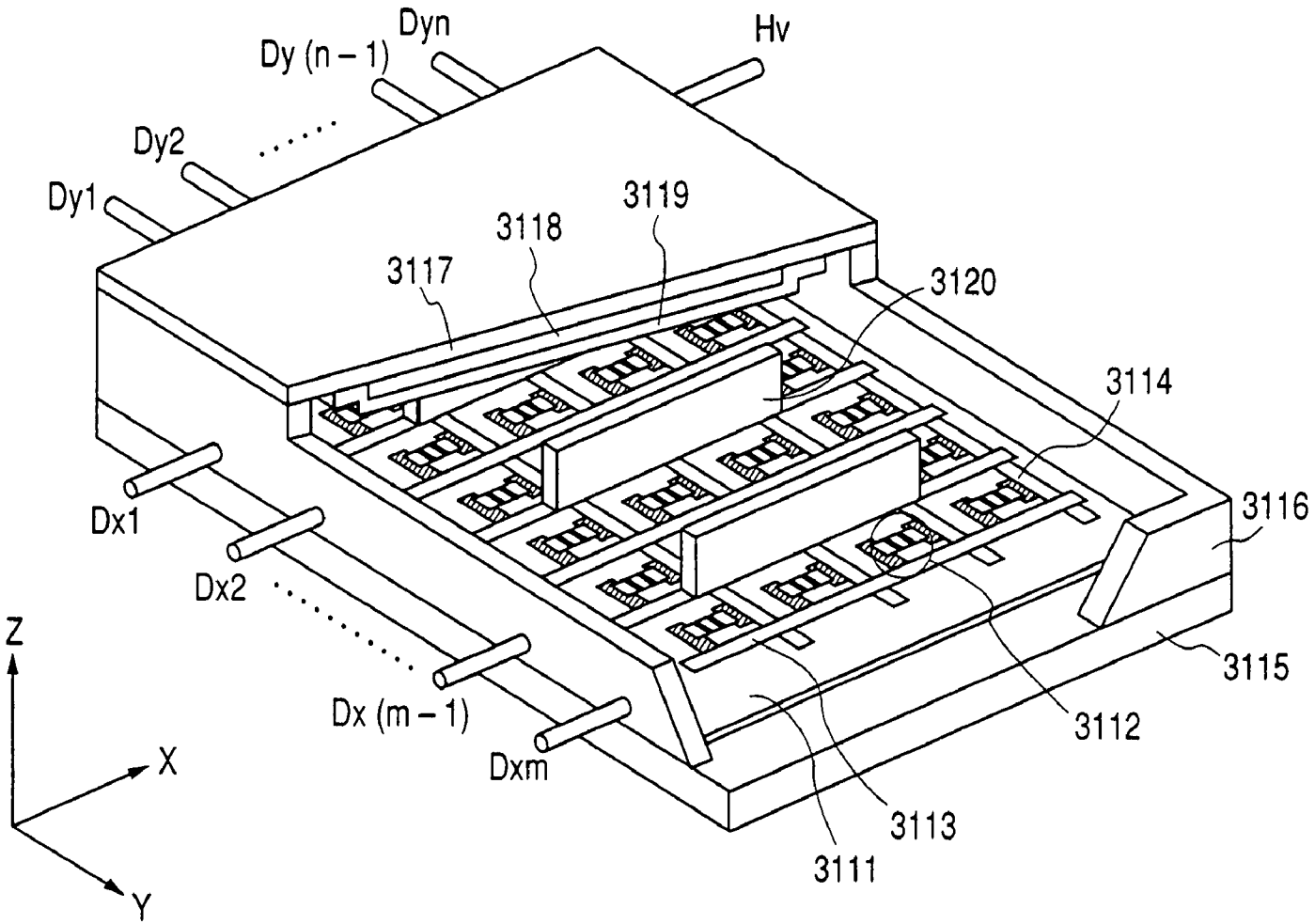
FIG. 7 (PRIOR ART)
FIG. 7 is a perspective view of a display panel, with some portions cut off, of a conventional flat type image display apparatus.

Each of the first and second substrates takes a plate-like shape, and there is no restriction about an external shape of its main surface. Normally, however, at least any one of the first and second substrates is a plate of which the external shape is substantially rectangular. The external frame is provided in a shape substantially conforming with this external rectangular shape of the substrate or provided substantially in conformity with a shape into which the above rectangular shaped is reduced inwards. Namely, as shown in FIG. 7 explained in the prior art or FIGS. 1 and 5 that will be illustrated in detail later on, the general frame is a square-shaped frame (both of the inside and the outside of the external frame are rectangular). Further, the wire to, e.g., the electron source of the image display apparatus is led out towards mainly the side of the rectangular substrate, and consequently there exists, at a corner of the rectangular substrate, a space allowance for providing the electrode for specifying the electric potential in many cases. Hence, according to one mode of the present invention, it is preferable that the second conductive member be positioned at the corner, particularly on the outer side surface of the corner of the external frame. Thus, it is preferable that the second conductive member be formed not over the entire surface other than the opposite surface of the external frame but partially on the surface other than the opposite surface.

Further, a method of manufacturing the image display apparatus including the first substrate, the second substrate and the external frame provided between these substrates has a connecting process of connecting the first substrate and the external frame to each other. The above connecting process can include a process of disposing, on at lest one of the first substrate and the external frame, a connecting material for connecting the first substrate and the external frame to each other, and a heating process of heating the connecting material in a state where the connecting material is position between the first substrate and the external frame, connecting the first substrate and the external frame together through the connecting material, and leading the connecting material softened by heating to the surface other than the surface, facing the first substrate, of the external frame.

The connecting material may suffice if it exhibits a conductivity in a state where at least the heating process has been finished. For instance, the metal having the melting point that is as low as 400° C. or lower, which has been described by way of the aforementioned first conductive member, is employed, and In is preferably used. Further, in addition, oxide metal series can be also used as those exhibiting the conductivity in the state where the heating process has been finished.

The method of heating the connecting material in the heating process is also capable of heating by electrifying if the connecting material is conductive, however, it is preferable that other heating method be employed in combination even in the case of utilizing the electrification heating. A preferable heating method involves heating based on radiation of electromagnetic waves or heating based on heat conduction from a heat source or these two heating methods in combination.

Moreover, for leading the connecting material to the surface other than the opposite surface in a desired position, there can be exemplified a method (i) of optimizing a coating profile and a coating quantity of the connecting material, and a method (ii) of processing at least one of the external frame and the first substrate.

The connecting material is so provided as to normally make a round of the external frame in a way that extends in line within at least one of the interior of the opposite surface of the external frame and the interior of the opposite area of the first substrate. According to the method (i) of optimizing the coating profile and the coating quantity of the connecting material, however, it is preferable that the connecting material be disposed in (the portion for leading it to the surface other than the opposite surface of the external frame) so that a line width of the connecting material is widened, and this widening portion spreads out towards (the leading portion). Namely, in (the leading portion), as for the connecting material disposed along the external frame, it is preferable that a distance between the connecting material and a boundary of the opposite surface be shorter than other portions, and, as for the connecting material disposed on the first substrate, t is preferable that a distance between the connecting material and a boundary of the opposite area be shorter than other portions.

In the case of leading the connecting material at the corner to the surface other than the opposite surface of the external frame, there can be exemplified a method of coating the connecting material on at least one of the external frame and the first substrate, preferably on both of them so as to form a pointed protruded portion in a shape conforming with the shape of the external frame at the corner of the external frame. In the case of coating the connecting material on both of the external frame and the first substrate, the connecting material coated on the external frame and the connecting material coated on the first substrate are integrally bonded by heating, and an extra bonding member flows out of the protruded portion for the first time, whereby the position for leading the connecting material to the surface other than the opposite surface of the external frame can be controlled.

Further, (in the portion for leading to the surface other than the opposite surface of the external frame), it is preferable that the quantity of the connecting material to be disposed be made larger than in other portions.

Moreover, a method of disposing an easy affinity member (in the portion for leasing to the surface other than the opposite surface of the external frame) can be given as the method (ii) of processing at least one of the external frame and the first substrate in order to lead the connecting material to the surface other than the opposite surface in the desired position. Herein, the easy affinity member is what a surface tension between the easy affinity member and the softened connecting material is smaller than a surface tension between a surface vicinal to the easy affinity member and provided with no easy affinity member and the softened connecting material. The connecting material can be led to the surface other than the opposite surface of the external frame in the desired position by disposing the easy affinity member on the surface (which is normally the side surface) other than the opposite surface of the external frame, this surface being the portion to which the connecting material is actually to be led.

EXAMPLES

The present invention will hereinafter be discussed in greater detail by way of examples.

Example 1

Figure 2:
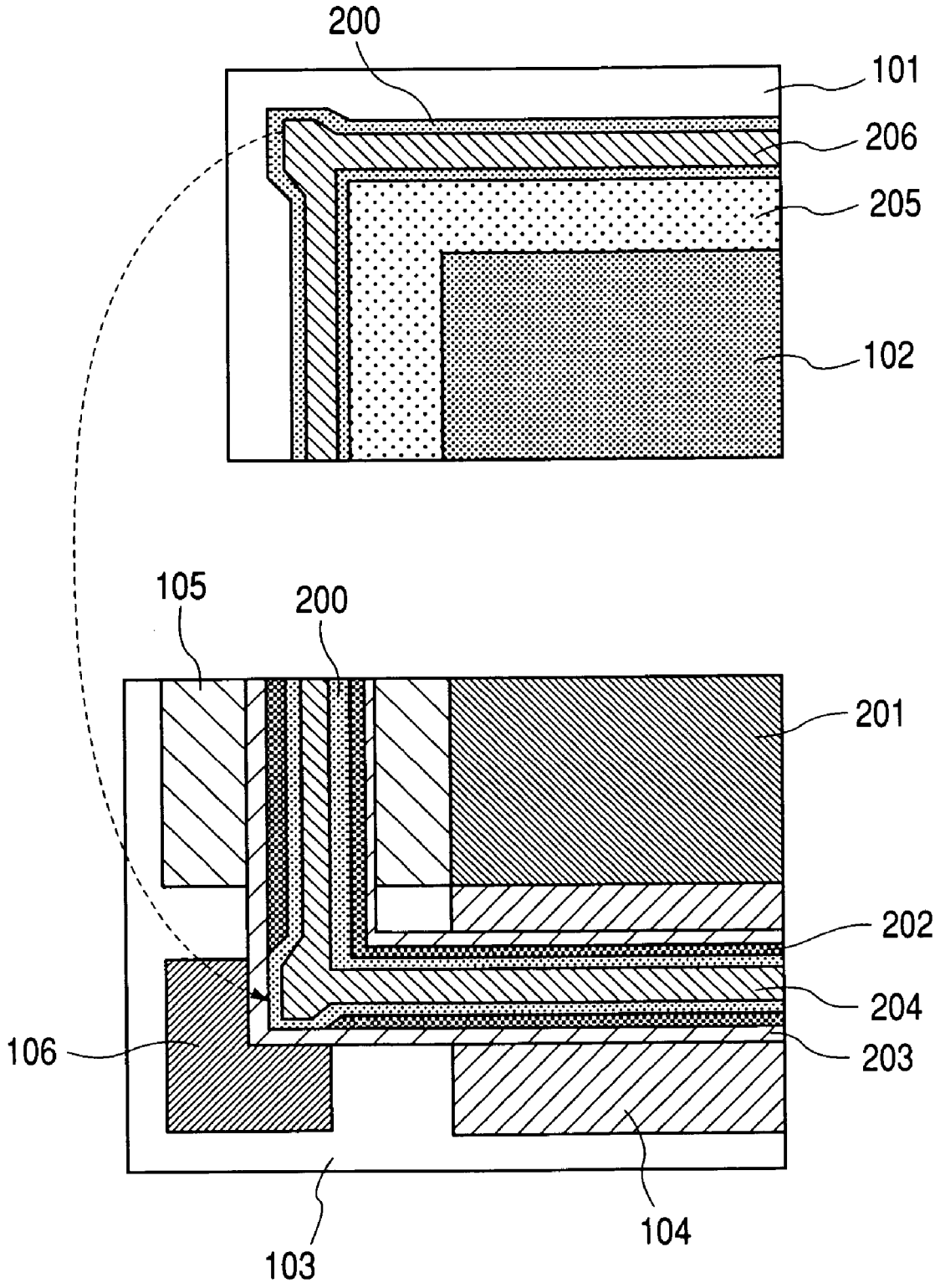
FIG. 2 is an explanatory partial view showing a way of assembling, illustrating the example 1.
Figure 3:
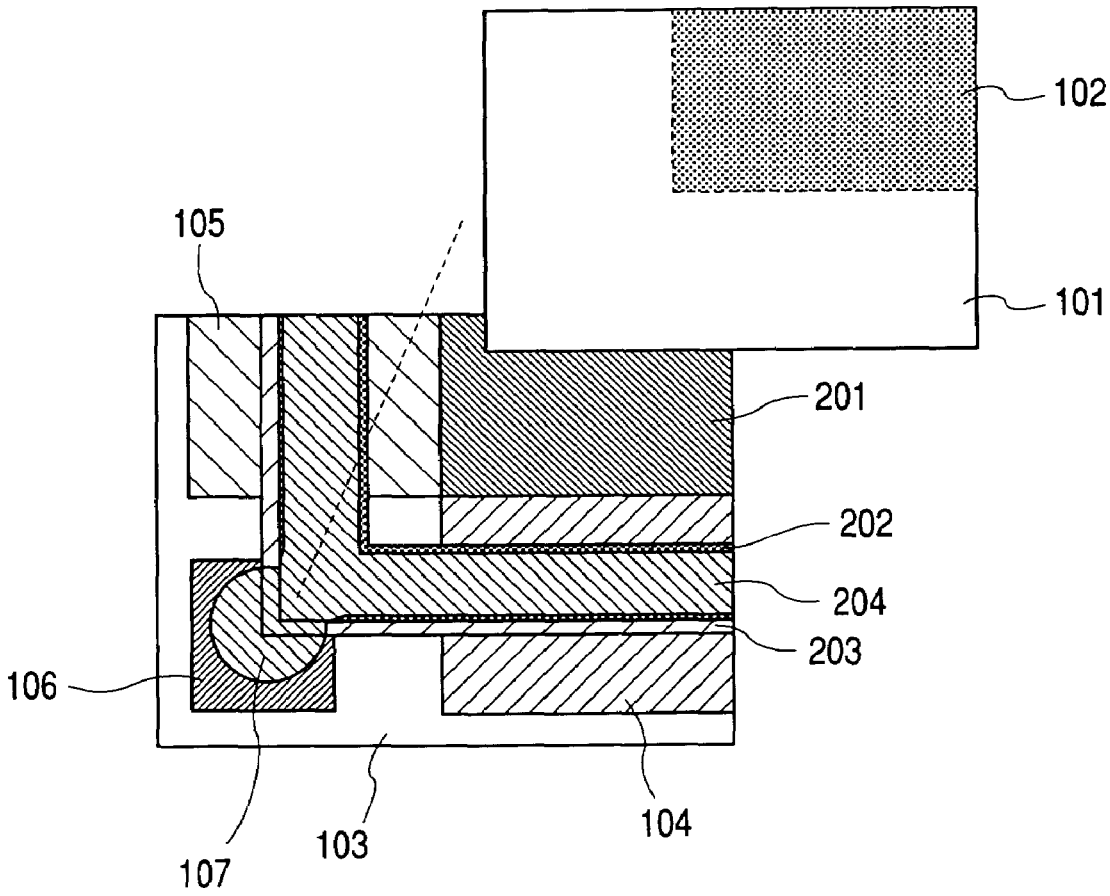
FIG. 3 is an explanatory partial view showing the way of assembling, illustrating the example 1.

A concrete explanation will be given with reference to FIGS. 1 through 3 and 4A and 4B. FIG. 1 schematically shows one example of a panel structure according to the present invention. FIGS. 2 and 3 show explanatory enlarged exploded views of a left lower portion, showing a method of manufacturing the panel having the structure shown in FIG. 1. FIG. 2 shows a state before a face plate 101 is bonded to a rear plate 103. FIG. 3 shows a state after the face plate 101 has been bonded to the rear plate 103 by use of a bonding member. FIGS. 4A and 4B are explanatory exploded sectional view showing the method of manufacturing the panel having the structure shown in FIG. 1. FIG. 4A is the sectional schematic view illustrating a state before the face plate 101 is bonded to the rear plate 103. FIG. 4B is the sectional schematic view illustrating a state after the face plate 101 has been bonded to the rear plate 103.

Next, the specific structure will be explained in greater detail. The face plate 101 is composed of a soda-lime glass material including an image forming member formed of a phosphor that becomes luminous by electrons emitted from an electron source. The numeral 102 represents an image forming area. The rear plate 103 serves as a substrate for forming the electron source and is a plate in which surface conduction type electron emitting elements disclosed in Japanese Patent Application Laid-Open No. 7-235255 are arrayed in matrix. The rear plate 103 involves the use of the same glass material as that of the face plate 101.

As shown in FIG. 2, the electron source area 201 is so configured as to be laid out in a position that faces an image forming area 102. An external frame 202 is disposed between the face plate 101 and the rear plate 103 and is formed by working in a frame-like shape the same glass material as the face plate 101 and the rear plate 103 are composed of. The external frame is fixedly bonded to the rear plate 103 by use of a frit 203, and this frit (LS3081) utilized in this example 1 is made by Nippon Electric Glass Co., Ltd. A bonding member 204 is composed of In and coated over an upper surface of the external frame 202. In this example 1, In is adopted as a connecting material having both of a bonding function and a hermetic connecting function. An insulation area 205 ensures a creepage distance in order to secure a withstand voltage, and a base material 200 is a material (such as Ag, Cu, In, Au, Ni, Ti, etc.) capable enhancing bondability of the bonding member. A bonding member 206 is formed by coating the in material over the surface, on the side of the image forming area, of the face plate 103 in a position opposite to the bonding member 204. A coating width of each of the face plate 101 and the rear plate 103 is set narrower than a width of the external frame 202 excluding the corner portions inconsideration of sagging on the occasion of bonding the face plate 101 and the rear plate 103 together by heating them up to a melting point of the bonding member (a manufacturing method thereof will be explained later on). As shown in FIGS. 4A and 4B, at the corner, when bonding the face plate 101 and the rear plate 103 to each other by heating them, the materials of the bonding member 204 and of the bonding member 206 are bonded together and overhang as sagging in a form that extends along the shape of the external frame 202. The pointed overhang becomes an origin from which an extra material of the molten bonding members 204 and 206 bonded together flows first. Further, a thickness of each of the bonding member A204 and the bonding member B206 is adjusted not to protrude from the external frame 202 excluding the corners when bonding the face plate 101 and the rear plate 103 to each other. The bonding members protruding from the corners reach the rear plate via the outer side surfaces of the external frame and come into contact with potential specifying electrodes 106 formed at the four corners of the rear plate 103. A proper electric potential (e.g., a ground level) is applied to this potential specifying electrode, whereby an electric potential of the bonding member 206 of the face plate 101 can be specified on the side of the rear plate 103.

Accordingly, in this mode, the materials of the bonding member 204 and of the bonding member 206 are bonded into one united body, the portion positioned between the external frame and the first substrate at that time becomes the first conductive member, and the portion protruding from the opposite surface and formed on the outer side surface along the external frame 202 corresponds to the second conductive member. According to this example 1, the sagging portion of the same connecting material as that of the first conductive member becomes the second conductive member, and hence it is preferable that the second conductive member be composed of the same material as that of the first conductive member.

Further, in the example 1, the potential specifying electrodes 106 are formed at the four corners on the rear plate 103, and the second conductive member is connected to these electrodes 106. This is because it was preferable that the potential specifying electrodes be provided in the positions of the four corners as spaces available in positions in terms of a pattern of lead-out wiring 104 for a modulation drive or lead-out wiring 105 for a scan drive. If the potential specifying electrodes are, however, without being limited particularly to the corners, formed not at the corners but on the sides in a way that gives a contrivance to, e.g., the pattern of the lead-out wiring 104 for the modulation drive or the lead-out wiring 105 for the scan drive, the second conductive members can be provided in positions corresponding thereto. Moreover, in this example 1, the second conductive members are disposed in the four places (i.e., the four corners), however, the second conductive member may be disposed in at least one place without being limited to the four places.

Note that a large atmospheric pressure sustaining spacer can be disposed in the case of creating a panel having a large areal size.

Next, the processes of manufacturing and bonding the face plate 101 and the rear plate 103 will be respectively explained referring to FIGS. 2 through 4.

The manufacturing process of the face plate 101 will be described.

To start with, an example of configuring a fluorescent screen defined as the image forming member will be discussed. The image forming area 101 is constructed of members such as the fluorescent screen (not shown), a black-striped member and a metal-backed member. The fluorescent screen can be constructed of only the phosphor in the case of monochrome. In the case of a color fluorescent screen, this screen can be constructed of a black conductive member called a black-striped member or a black matrix member, of which naming depends on how the phosphors are arrayed. A purpose of providing the black-striped member and the black matrix member lies in, in the case of a color display, making a color mixture inconspicuous by blackening coloring sections between the respective three primary color phosphors required, and lies in restraining a decline of contrast due to a reflection of the external light on the fluorescent screen. In addition to normally used materials of which a main component is graphite, materials exhibiting the conductivity and small quantities of transmission and reflection of the light, can be used as materials of the black-striped member.

A method of coating the phosphor on the image forming area 102 can involve adopting a precipitation method, a printing method, etc. irrespective of the monochrome and the color. Normally, the metal-backed member is provided on the inner surface side of the fluorescent screen. The purpose of providing the metal-backed member lies in improving a luminance by causing a mirror reflection of a beam of light directed to the inner surface among beams of light emitted from the phosphor towards the face plate 101, making the metal-backed member function as an electrode for applying an electron beam acceleration voltage, and protecting the phosphor from an damage caused by impingement of negative ions generated within the envelope unit. The metal-backed member can be manufactured by executing a smoothing process (which is normally known as (filming)) on the surface of the inner surface of the fluorescent screen after manufacturing this fluorescent screen and thereafter depositing Al by the vacuum vapor deposition, etc.

The manufacturing method of the rear plate 103 will hereinafter be explained.

The electron source area 201 is, as disclosed in Japanese Patent Application Laid-Open No. 7-235255, extended up to the outside of the external frame 202 in such a form that the surface conduction type electron emitting elements (not shown) are arrayed in matrix and driven, and the lead-out wiring 104 for the display-purposed modulation drive and the lead-out wiring 105 for the scan drive are connected to wiring distributed in the electron source area. The lead-out wiring 104 for the modulation drive and the lead-out wiring 105 for the scan drive are formed on the rear plate 103 through a process of patterning an Ag paste material by the known printing method and a sintering process. On this occasion, a potential specifying pattern is simultaneously formed by use of the Ag paste material.

Given next is an explanation of a process of fixedly bonding the external frame 202 onto the rear plate 103 formed with the wiring pattern described above by use of the frit 203. The base material 200 is formed on the external frame 202 by use of the Ag paste material that is formed by the known printing method The powder LS 3081 as the frit material is coated by a dispenser device in a position for bonding the external frame 202 on the rear plate 103 and is tentatively sintered (380° C.). Subsequently, the external frame 202 is aligned on the tentatively-sintered frit 203 and is thereafter heated at a final sintering temperature (420° C.). On this occasion, the external frame 202 is sunk by applying a load on the frit 203. In this process, the external frame 202 is fixedly bonded to the rear plate 103 through the frit 203.

Next, the process of bonding the face plate 101 and the rear plate 103 together will be described.

The face plate 101 and the rear plate 103 are put into a vacuum chamber capable of heating the unillustrated substrate, performing an alignment (X, Y) and executing interval control. The face plate 101 and the rear plate 103 are aligned with each other by use of alignment marks (not shown) formed on the respective plates within the vacuum chamber. On this occasion, the face plate 101 and the rear plate 103 are in such positions as to be spaced from each other. In this state, a substrate heating device raises a temperature of each of the face plate 101 and rear plate 103 till a melting point of each of the bonding member A204 and the bonding member B206 is reached. Next, an interval control device controls an interval by making the face plate 101 and the rear plate 103 proximal to each other so that the bonding member A204 and the bonding member B206 are bonded together, and the extra members protrude into the potential specifying patterns 106 disposed at the four corners of the rear plate 103. This control is to be carefully performed so as not to protrude at the respective sides of the external frame 202. Thereafter, the substrate temperature being lowered, the face plate 101 and the rear plate 103 are bonded into a container. Thereafter, the container is taken out of the vacuum chamber into the atmosphere, thereby completing a vacuum hermetic container in which the interior of this container encompassed by the face plate 101, the rear plate 103, the external frame 202, the bonding member A204 and the bonding member B206 is kept in vacuum.

Next, a bonding state of the corner portion in the bonding process described above will be explained.

As illustrated in FIG. 4A, in the aligning state within the vacuum device, the face plate 101 and the rear plate 103 are in the state of being spaced from each other, and the bonding member A206 and the bonding member B204 are in their initial coating positions. Subsequently, upon entering the bonding process within the vacuum device, as shown in FIG. 4B, the bonding member A206 and the bonding member B204 are connected to each other, and the extra members protrude from the positions of the four corners, flow along the external frame 202 and the frit 203 and reach the potential specifying patterns 106, whereby the bonding members are thus bonded (107). The bonding members, just when protruding, have previously been bonded to the external frame 202 and to the face plate 101.

Thereafter, as the temperature is lowered, as shown in FIG. 1, the bonding members 107 are solidified at the four corners, thereby forming a structural body. With this structure, the potential specifying patterns 106, the bonding members 107 and the bonding member A206 of the face plate 101 become electrically conductive. After being checked by a continuity tester, it was confirmed that a continuity through those members is attained with a resistance on the order of several ohms (Ω).

When this display panel is connected to a drive electric system (not shown), it was confirmed that the drive display can be performed stably without being influenced by discharging, etc.

Example 2

Figure 5:
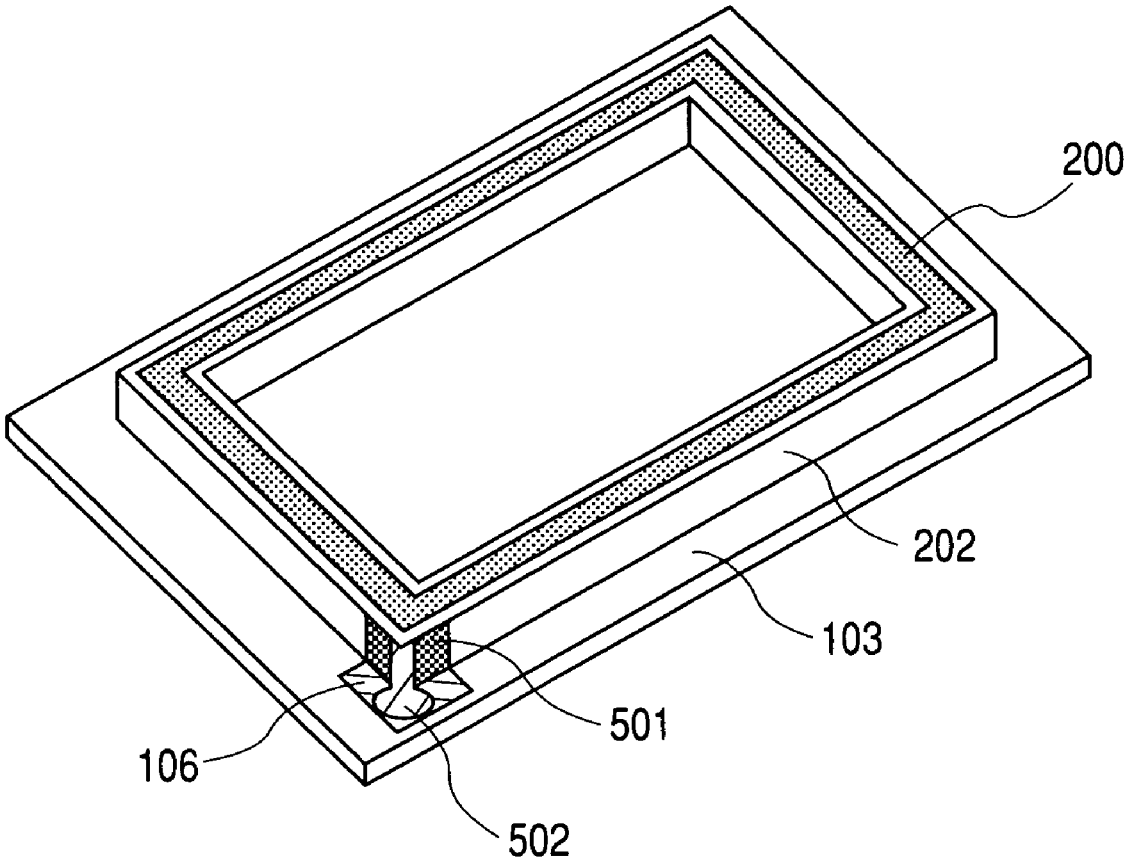
FIG. 5 is a perspective view illustrating an example 2.
Figure 6A:
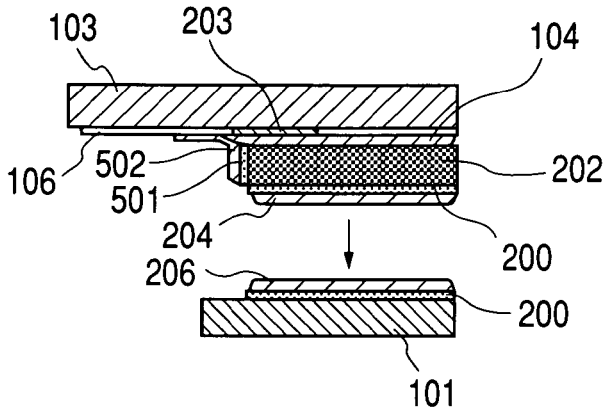
FIGS. 6A, 6B and 6C are partial sectional views of the display panel, illustrating the example 2.
Figure 6B:
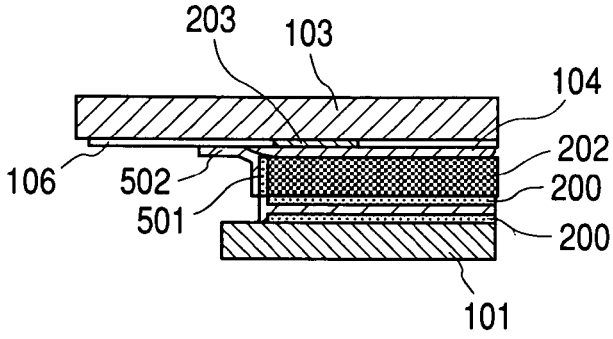
Figure 6C:
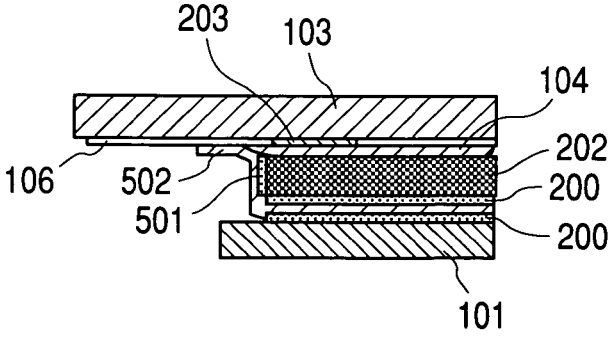

Another example will be described referring to FIGS. 5 and 6A to 6C. FIG. 5 is a view showing a configuration in which the external frame member 202 is bonded to the rear plate 103. FIGS. 6A, 6B and 6C are partially sectional process explanatory views for illustrating a process of bonding the face plate 101. Referring to FIGS. 5 and 6A to 6C, a side wall base material 501 is formed on a side wall of the corner portion of the external frame 202 in order to enhance a wettability, and a corner bonding member 502 serves to make the side wall base material 501 electrically conductive to the potential specifying pattern 106 formed at the corner portion of the rear plate 103. Taking the aforementioned point into consideration, the side wall base material 501 involves the use of Ag, Cu, In, Au, Ni, Ti, etc., and preferably the Ag paste material is used. The corner bonding member 502 preferably involves using In. Note that the example 2 has taken the assembling process in which the rear plate 103 disposed upwards and the face plate 101 disposed downwards are assembled together.

As shown in FIG. 5, the side wall base material 501 is formed on the side wall of the external frame 202. A forming method is that the Ag paste material is coated in a desired position to have a thickness of about 10 μm and is thereafter heated, the a solvent component of the Agg paste is removed, and cooling is effected, thereby forming the side wall base material 501. A variety of heating/cooling conditions are selected. Note that though not described in depth in this example 2, the same base material 200 as in the example 1 is formed on the surface abutting on the face plate of the external frame simultaneously when forming the side wall base material 501.

The completed external frame 202 is bonded to the rear plate 103 in a desired position by use of the frit 203 as in the example 1. In this state, the rear plate 103 and the external frame 202 fall into a fixed state. In this fixed state, the side wall base material 501 is not electrically conductive to the potential specifying electrode 106. The In material is used as a material of the corner bonding member 502, wherein In is coated by use of an ultrasonic soldering iron to form the corner bonding member 502. In this state, the corner bonding member 502 is electrically conductive to the potential specifying electrode 106.

Next, the bonding state of the corner portion in the bonding process of the face plate 101 will be explained in detail with reference to FIGS. 6A to 6C. The panel assembling process is the same as in the example 1.

As shown in FIG. 6A, in the aligning state within the vacuum device, the face plate 101 and the rear plate 103 are in the state of being spaced from each other, and the bonding member A206 and the bonding member B204 are in their initial coating positions. Next, upon entering the bonding process within the vacuum device, as shown in FIG. 6B, the interval control is executed so that a pressure is applied onto the bonding member A206 and the bonding member B204 simultaneously when connected, with the result that these bonding members A206 and B204 expand in a gap direction and connect to the corner bonding member 502 formed beforehand. Once the bonding members A206 and B204 connect to the corner bonding member 502, these members are fluid and therefore structured into one united body without any discontinuity. On this occasion, the electric conduction can be attained simultaneously. FIG. 6C shows the state described above.

Thereafter, as the temperature is decreased, the bonding member A206, the bonding member B204 and the corner bonding member 502 are solidified and thus formed into a structural body. Simultaneously, the electric conduction from the potential specifying pattern 106 to the face plate 101 is attained. After being checked by the continuity tester, it was confirmed that a continuity through those members is attained with a resistance on the order of several ohms (Ω).

Accordingly, in this example 2, the first conductive member is the member positioned between the external frame and the first substrate after the bonding member A206 and the bonding member B204 as the connecting materials have bonded into one united body. Further, the second conductive member is the member into which the bonding member A206 and the bonding member B204 as the connecting materials are bonded into one united body and the extra members protruding therefrom are connected to the corner bonding member 502.

Note that the side wall base material 501 and the potential specifying electrode 106 are, if remaining as they solely are, not electrically conductive but may be made conductive without being limited. Further, there is no limit with respect to the configuration, the number of formations and the positions of the formation of the side wall base material 501, and these elements may be properly selected.

The configuration in this example 2 also is that the potential specifying electrodes 106 are formed at the four corners on the rear plate 103, and the second conductive members are electrically connected these electrodes 106. If the potential specifying electrodes are formed not at the corners but on the sides as in the example 1, however, the positions for providing the second conductive members can be set corresponding thereto moreover, according to this example 2, the second conductive members are disposed, however, it is the same as in the example 1 that the second conductive members may be disposed in at least one place without confined to the four places.

Further, though not discussed in detail, it is possible to utilize the same coating pattern of the connecting material as in the example 1.

The structure of the example 2 enabled the bonding members to become conductive stably without being influenced by the directions of assembling the face plate 101 and the rear plate 103.

The present invention discussed above can provide the image display apparatus and its manufacturing method capable of performing the drive display with the stability.

Moreover, the present invention discussed above makes it feasible to actualize the preferable configuration for specifying the electric potentials of the connecting members (the conductive connecting members). In particular, it is possible to actualize the structure capable of facilitating the electrical lead-outs from the connecting members (the conductive connecting members) for specifying the electric potentials and also the construction capable of easily specifying the electric potentials.

What is claimed is:

1. An image display apparatus comprising:

a hermetic container including, as constructive members, a first substrate and a second substrate opposite to each other, with an electrode having a specified electric potential, and an external frame disposed between said first substrate and said second substrate, with said electrode disposed on said second substrate and located outside of said hermetic container;

image display means and wiring for displaying disposed within said hermetic container;

a conductive bonding member for sealing said first substrate and said external frame, said bonding member extending outside of said hermetic container, from a sealing area between said first substrate and said external frame to said electrode to be in contact with said electrode; and a frit that separates said conductive bonding member from said wiring for displaying.

2. An image display apparatus according to claim 1, wherein the electric potential of said electrode is specified at a constant level.

3. An image display apparatus according to claim 1, wherein the electric potential of said electrode is specified at a ground level.

4. An image display apparatus comprising:

a hermetic container including, as constructed members, a first substrate and a second substrate, opposite to each other, with an electrode having a specified electric potential, and an external frame disposed between said first substrate and said second substrate, with said electrode disposed on said second substrate and located outside of said hermetic container;

image display means disposed within said hermetic container; and a conductive bonding member for sealing said first substrate and said external frame, said bonding member extending outside of said hermetic container, from a sealing area between said first substrate and said external frame to said electrode to come in contact with said electrode.

5. An image display apparatus according to claim 4, wherein the electric potential of said electrode is specified at a constant level.

6. An image display apparatus according to claim 4, wherein the electric potential of said electrode is specified at a ground level.

7. An image display apparatus comprising:

a first substrate;

a second substrate with an electrode, which is disposed opposite to said first substrate;

an external frame disposed between said first substrate and said second substrate, with said electrode disposed on said second substrate and located outside of said external frame; and a conductive bonding member for sealing said first substrate and said external frame, which is disposed between said first substrate and said external frame, wherein said conductive bonding member extends outside of said external frame, from an area between said first substrate and said external frame to said electrode to be in contact with said electrode.

8. An image display apparatus according to claim 7, wherein at least said first substrate, said second substrate, said external frame, and said conductive bonding member form a hermetic container.

* * * * *

UNITED STATES PATENT AND TRADEMARK OFFICE

CERTIFICATE OF CORRECTION

PATENT NO. : 7,304,429 B2
APPLICATION NO. : 10/606234
DATED : December 4, 2007
INVENTOR(S) : Toshimitsu Kawase It is certified that error appears in the above-identified patent and that said Letters Patent is hereby corrected as shown below:

COLUMN 1:

Line 50, “lie-directional” should read --line-directional--.

COLUMN 8:

Line 56, “t” should read --it--.

COLUMN 10:

Line 19, “incosideration” should read --in consideration--.
Line 32, “A204” should read --204-- and “B206” should read --206--.

COLUMN 13:

Line 36, “Agg” should read --Ag--.

COLUMN 14:

Line 43, “Thereto moreover,” should read --thereto. Moreover,--.

Signed and Sealed this

Third Day of February, 2009

JOHN DOLL
*Acting Director of the United States Patent and Trademark Office*